US007144354B2

(12) United States Patent
Donde'

(10) Patent No.: US 7,144,354 B2
(45) Date of Patent: Dec. 5, 2006

(54) BALLS, BALLOONS AND OTHER INFLATABLE OBJECTS FOR GYMNASTIC OR THERAPEUTIC USE

(75) Inventor: Steno Donde', Moruzzo (IT)

(73) Assignee: Ledragomma S.R.I. (IT)

( * ) Notice: Subject to any disclaimer, the term of this patent is extended or adjusted under 35 U.S.C. 154(b) by 0 days.

(21) Appl. No.: 10/480,891

(22) PCT Filed: Jun. 13, 2002

(86) PCT No.: PCT/EP02/06507

§ 371 (c)(1),
(2), (4) Date: Dec. 15, 2003

(87) PCT Pub. No.: WO02/102476

PCT Pub. Date: Dec. 27, 2002

(65) Prior Publication Data

US 2004/0147382 A1 Jul. 29, 2004

(30) Foreign Application Priority Data

Jun. 15, 2001 (IT) ..... MI2001A1268

(51) Int. Cl.
*A63B 71/00* (2006.01)

(52) U.S. Cl. ..... 482/148; 446/220

(58) Field of Classification Search ..... 482/148; 446/220; 473/603–605, 598–599, 569; D21/689, D21/835, 707, 811; 273/118; 604/103.01; 244/31

See application file for complete search history.

(56) References Cited

U.S. PATENT DOCUMENTS 5,181,717 A 1/1993 Donntag et al.
5,558,325 A * 9/1996 Hargis et al. ..... 473/606
5,961,363 A * 10/1999 Spector ..... 446/81
6,664,205 B1 * 12/2003 Oda et al. ..... 501/80
6,685,585 B1 * 2/2004 Shishido et al. ..... 473/605

* cited by examiner

*Primary Examiner*—Lori Amerson
(74) *Attorney, Agent, or Firm*—Lorusso & Associates

(57) ABSTRACT

Balls, balloons and other inflatable objects made from a plastic material with an improved resistance to tearing, suitable for use in gymnastic activities, for rehabilitation and physiotherapy comprise as stiffening material an inert mineral charge having a granulometry between 0.02 μ and 500 μ, in an amount between 0.50% and 20% by weight.

6 Claims, 1 Drawing Sheet

BALLS, BALLOONS AND OTHER INFLATABLE OBJECTS FOR GYMNASTIC OR THERAPEUTIC USE

CROSS REFERENCE TO RELATED APPLICATIONS

This application is a national stage filing under 35 U.S.C. 371 that claims benefit to PCT/EP02/06507 filed Jun. 13, 2002, which claims priority to MI2001A001268 filed on Jun. 15, 2001, the contents of both are incorporated by reference in their entirety.

FIELD OF THE INVENTION

The present invention refers to balls, balloons and other inflatable objects made from a plastic material, with an improved resistance to tearing, for gymnastic or therapeutic use.

STATE OF THE ART

For several decades balls and balloons used for gymnastics have been used by physiotherapists, especially in orthopedics, for re-education after an accident and in postural rehabilitation; thanks to the level of deformation of these balls and to their size, they have rapidly become widespread in gyms and schools as well as in private homes where they are used for gymnastics, to relax or to play.

The main problem related to the use of these balls consists in the possibility of a ball breaking when it comes into contact with objects having sharp or cutting edges.

In the case of breakage during use, due to the internal air pressure and the load applied on the ball, the surface of the ball may tear immediately resulting in the subsequent explosion of the same and the risk that the person supported may fall to the ground with the risk of physical injury.

Therefore, in order to reduce the risk of injury to people using these kinds of products, the need of balls and balloons that are more resistant to tearing, and therefore are much safer, is felt.

SUMMARY

The Applicant has now found that it is possible to improve the resistance to tearing of these balls and balloons by adding a stiffening material to the plastic, which maintains the other desired characteristics of the object, especially in terms of deformation.

Figure 1:
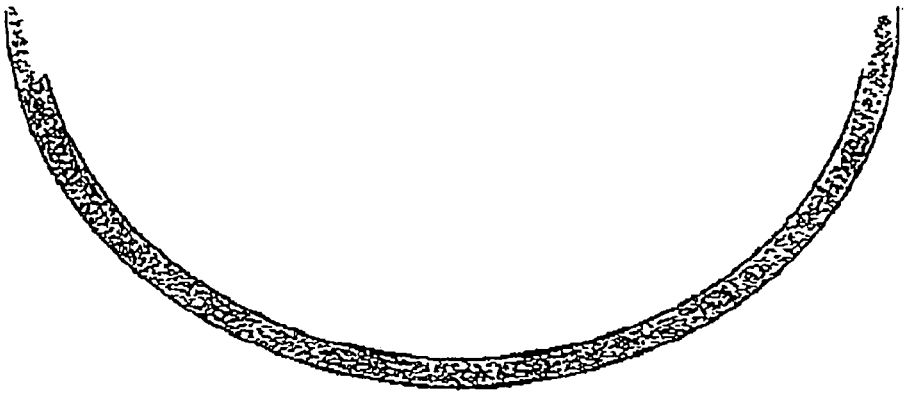
FIG. 1 is a partial sectional view of the wall of an inflatable object according to one embodiment of the invention.
Figure 2:
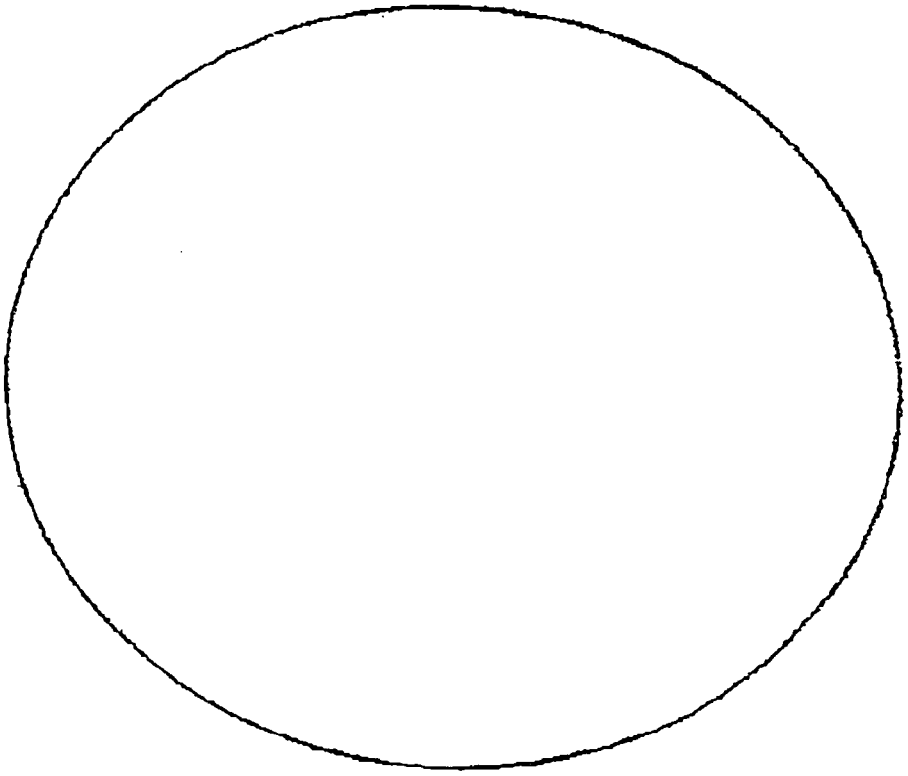
FIG. 2 is a plan view of the wall of an inflatable object according to one embodiment of the invention.

Subject of the present invention are therefore balls, balloons and other inflatable objects for gymnastic or therapeutic use made of a plastic material comprising as stiffening material at least an inert mineral charge having a granulometry comprised between 0.02 μm and 500 μm, in an amount comprised between 0.50% and 20% by weight with respect to the total weight of the product.

DETAILED DESCRIPTION OF THE INVENTION

The balls, balloons and other inflatable objects according to the invention comprise a stiffening material constituted by mineral charges of suitable granulometry and in suitable amounts with respect to the total amount of plastic material used, distributed uniformly in the plastic material during the process for preparing this material.

The plastic material is preferably polyvinylchloride (PVC).

The granulometry of the mineral charges according to the invention must be comprised between 0.02 μm and 500 μm, preferably between 0.5 and 200 μm, and more preferably lower than 150 μm.

The quantity of mineral charges must be comprised between 0.50% and 20% by weight with respect to the total weight; the amount of the mineral charges is preferably comprised between 2% and 10%, and more preferably is 4% by weight. According to a preferred embodiment of the invention, the inert mineral charges are selected from the group consisting of silica, alumina, carbon black, graphite, clay, perlite, zeolite and mixtures thereof.

Preferred mineral charges according to the invention are silica and perlite; perlite is particularly preferred.

As used herein, the term "perlite" refers to the product deriving from the perlite ore, which belongs to the class of natural glasses, i.e. volcanic glasses formed by the rapid cooling of siliceous magma or lava. It is a porous material, chemically inert, consisting essentially of silica and alumina; the perlite ore typically contains approximately 71–75% by weight of $SiO_2$, 12–15% of $Al_2O_3$, 0.5–2% of $Fe_2O_3$, 3–5% of $Na_2O$, 4–10% of $K_2O$, 0.2–1.5% of CaO, and small concentrations of other metallic elements.

Numerous perlite products are commercially available: a perlite suitable for the scope of the present invention is for example the commercial product ENOPERLITE®, a filtration adjuvant used in the enological field, having the following composition, expressed as percentage by weight:

71–74% $SiO_2$
13.0–14.5% $Al_2O_3$
0.6–0.8% $Fe_2O_3$
3.0–4.0% $Na_2O$
8.6–9.0% $K_2O$
0.2–0.4% CaO
0.1–0.2% MgO.

Before use according to the invention, the commercial product ENOPERLITE® is preferably sieved in a vibrating screen to eliminate the particles that are more than 150 μm in size, in order to improve the aesthetic appearance of the final product.

As mentioned above, the plastic material preferably used according to the invention is polyvinylchloride, or mixtures thereof, to which other components are added such as plasticizers, stabilizers, fluidifiers and, according to the present invention, also the above mentioned mineral charges. It is also possible to add small percentages of other stiffening agents, different from the above mentioned mineral charges.

The process for the preparation of inflatable products made from plastic material consists in the introduction in suitable turbomixers of suitable amounts of polyvinylchloride in powder form and of the plasticizer in liquid form to confer a suitable level of elasticity to the product; stabilizing additives are then added to these materials to exclude any possible problem deriving from the pressing temperatures; fluidifiers may also be optionally added to make the mixture more smooth during the pressing process; coloring pastes are also added to confer the desired level of color to the products. Inert mineral charges according to the present invention are sieved in a vibrating screen in order to homogenize the granulometry, and are put into the turbomixers in this preparation phase to achieve an uniform distribution of the same inside the plastic material.

Once the stirring cycle within the turbomixers has been completed, the so obtained fluid material is loaded into moulds which will be subsequently introduced into furnaces where they will remain until the plastic material has reached a suitable level of gelation.

The moulds are removed from the ovens, then opened and the products, once extracted from the moulds, are inflated in suitable positions until the dimensions required are reached.

The addition of these mineral charges provide the products of the invention with greater resistance to tearing and improved aesthetic appearance with respect to the balls and balloons known in the art; the addition of the mineral charges has moreover highlighted a remarkable reduction on the surface of the migration of plasticizers, that is usual in products made with soft PVC, and disagreeable in the final product.

The invention claimed is:

1. Balls and balloons and other inflatable objects for gymnastic or therapeutic use made of a plastic material comprising as stiffening material at least an inert mineral charge having a granulometry comprised between 0.02 μm and 500 μm, in an amount comprised between 0.50% and 30% by weight with respect to the total weight of the product, wherein said inert mineral charge is a perlite having the following composition, expressed as a percentage by weight:

71–74% $SiO_2$
13.0–14.5% $Al_2O_3$
0.6–.0.8% $Fe_2O_3$
3.0–4.0% $Na_2O$
8.6–9.0% $K_2O$
0.2–0.4% CaO
0.1–0.2% MgO.

2. The ball, balloons and other inflatable objects according to claim 1, wherein the granulometry of said inert mineral charge is comprised between 0.5 μm and 200 μm.

3. The balls, balloons and other inflatable objects according to claim 1, wherein the granulometry of said inert mineral charge is lower than 150 μm.

4. The ball, balloons and other inflatable objects according to claim 1, wherein the amount of said inert mineral charge is comprised between 2% and 10% by weight with respect to the total weight.

5. The ball, balloons and other inflatable objects according to claim 1, wherein the amount of said mineral charge is 4% by weight with respect to the total weight.

6. The balls, balloons and other inflatable objects according to claim 1, wherein said plastic material is polyvinylchloride, possibly containing other stiffening materials different from the said mineral charges.

* * * * *